United States Patent [19]

Garrison

[11] 4,017,990

[45] Apr. 19, 1977

[54] ACCESSORY FOR ARTICLE DISPLAY TALLY

[75] Inventor: Judd F. Garrison, Grand Rapids, Mich.

[73] Assignee: John Thomas Batts, Inc., Zeeland, Mich.

[22] Filed: Jan. 7, 1976

[21] Appl. No.: 646,981

[52] U.S. Cl. ..... 40/322; 223/85

[51] Int. Cl.[2] ..... G09F 3/00

[58] Field of Search ..... 223/85, 86, 88, 92; 40/322, 20 A, 10 R

[56] References Cited

UNITED STATES PATENTS

| | | | |
|---|---|---|---|
| 1,348,952 | 8/1920 | Landry | 40/322 |
| 1,710,296 | 4/1929 | Clark | 40/322 |
| 3,949,914 | 4/1976 | Ostroll | 223/85 |

*Primary Examiner*—George H. Krizmanich
*Attorney, Agent, or Firm*—Price, Heneveld, Huizenga & Cooper

[57] ABSTRACT

An attachment for use with an article hanger such as a garment hanger is disclosed to provide a display means for indicia. The attachment is designed for use with a tubular tally surrounding the shank or the support hook of the hanger. A portion of the attachment is designed to be inserted in the open top of the tally. The part so inserted is wider than the inside diameter of the tally and is either partially folded and inserted in the tally or the tally is slightly distorted before the attachment is inserted. By virtue of the resilience of either the attachment or the tally or both, a tight wedging engagement is formed which firmly secures the attachment to the tally.

7 Claims, 7 Drawing Figures

ACCESSORY FOR ARTICLE DISPLAY TALLY

SUMMARY OF THE INVENTION

This invention relates to an attachment to be used with garment hangers and the like for the purpose of supplying special or additional information when articles suspended from the hanger are being displayed. The invention provides a detachable and reusable device which can be readily attached to or removed from the hanger as circumstances require. The construction of the device permits it to be attached by frictional interfit with a collar-like tally. In addition, the means within the tally by which the garment support is suspended such as the hook of a garment hanger causes a bending or deflection of the attachment portion of this device resulting in a positive frictional interfit with the tally. This arrangement provides a quick and simple means of attaching the device or removing it and, at the same time, permits its reuse as needed.

DESCRIPTION OF THE PREFERRED EMBODIMENT

Figure 3:
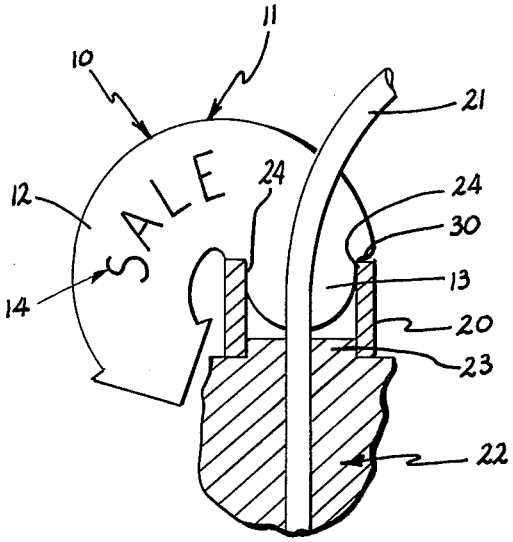
FIG. 3 is a fragmentary sectional view taken along the plane III—III of FIG. 2.
Figure 4:
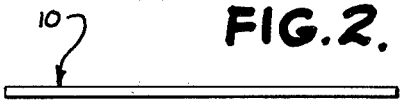
FIG. 4 is a plan view of the invention in its free state.

As best seen in FIG. 3, the attachment 10 has a body member 11. The body member 11 includes a display portion or arm 12 and a foot portion 13. The display arm and the foot portion are integral. As initially manufactured, the display and foot portion are all part of a flat sheet and, therefore, occupy a common plane. This is illustrated in FIG. 4.

The attachment is manufactured from a suitable plastic material such as being die cut from 0.020 inch rigid, vinyl sheet or high impact styrene. The material selected for this product must have resilience so that it can be bent and resiliently resist the bending in the manner of a spring. Preferably, it should have sufficient memory that it will return to its previous shape once it has been released from the forces which bent it. The necessity for these characteristics will be explained subsequently. The material is preferably opaque although this is not necessarily a required characteristic. The material should be one upon which indicia can be printed or otherwise applied such as by silk screening so that the device will display the desired indicia such as those identified by the number 14 in FIG. 3.

The device is designed for use in combination with a tally 20. The tally 20 is a circular collar which seats around the suspension means for the support or hanger such as the hook 21 of the hanger 22. It also is firmly anchored to the hanger 22 by a suitable anchor boss 23. The tally 20 and the means of its attachment to the hanger is the subject of commonly owned, copending application entitled TALLY FOR ARTICLE DISPLAYS, filed Jan. 7, 1976, Ser. No. 647,008.

Figure 2:
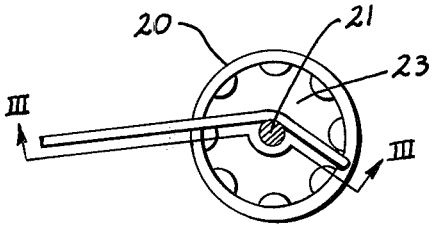
FIG. 2 is an enlarged sectional view taken along the plane II—II of FIG. 1.

It will be seen from FIGS. 2 and 3 that the foot portion 13 is designed to seat within the tally. However, the foot portion is wider than the inside diameter of the tally 20 and, thus, it must be bent to reduce this width so that it can be inserted down into the open top of the tally 20. In being so inserted, it is bent about the shank of the hook 21 which bears against the center part of the foot portion 13 and that part of the display portion 12 which is immediately above the hook portion. By reason of the resilient pressure generated as the result of the bending of the attachment, it is forced to press against the shank of the hook portion and this requires it to assume an erect position when its foot portion has been seated in the tally. It also acts as a positive means of maintaining this erect position during normal usage. At the same time, due to the resilience of the attachment, it attempts to straighten out, thus forcing the edges 24 of the foot portion 13 to wedge tightly against the inside wall of the tally 20, thus forming a positive frictional fit or anchor within the tally.

It will be seen from this description that the user merely has to bend the attachment sufficiently to permit the foot portion 13 to be inserted in the open top of the tally and upon release the tally will automatically assume a position pressed against the shank of the hook, thus completing its assembly to the hanger. Removal is just as simply accomplished. Upon bending the attachment enough to release the side edges of the foot portion 13 from the inside walls of the tally, the attachment can be removed by lifting it out of the tally. The attachment is then ready for reuse. Alternatively, the tally may be slightly distorted to render it oval, the foot portion then inserted, and upon release of the tally it will spring back to clamp the foot portion. It will be recognized that while the shank of the hook is an added support, the presence of the hook is not essential to the proper functioning of this invention.

In the preferred embodiment of this invention, the attachment has a stop shoulder 30 to limit the depth to which it is inserted in the tally 20. This, however, is optional.

Figure 1:
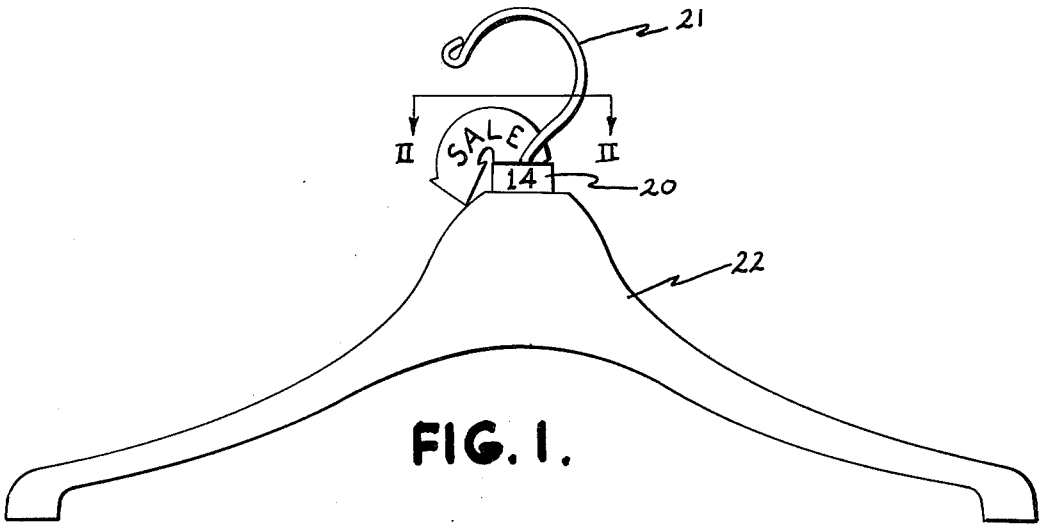
FIG. 1 is a front elevation view of a hanger equipped with this invention.
Figure 5:
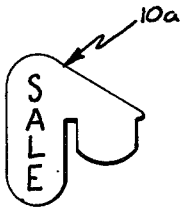
FIGS. 5, 6 and 7 illustrate different shapes for the invention.
Figure 6:
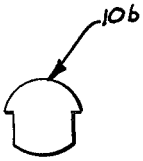
Figure 7:
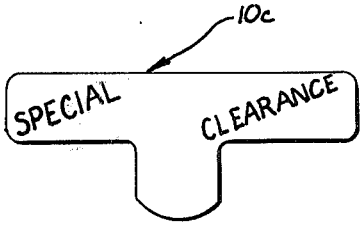

As seen in FIG. 1, the attachment provides additional information which cannot be properly displayed by the tally. For example, it can be used to particularly direct a prospective customer's attention to some special feature such as identifying the article as being on sale or, as suggested in FIG. 7, that it is the subject of a special clearance. FIGS. 5, 6 and 7 illustrate the fact that the attachment can take various forms such as the attachments 10*a*, 10*b* and 10*c*. The size and shape will depend upon the particular use as, for example, in FIG. 6 the display portion is quite small since this type of attachment is intended to be inconspicuous to the customer but to tell the sales personnel some particular item of information such as the age of the article being displayed. This invention is not limited by the size and shape of the display portion of the attachment.

While a preferred embodiment of this invention has been illustrated and described, it will be recognized that modifications of the invention can be made which will incorporate the principles of the invention. Such modifications are to be considered as included in the hereinafter appended claims, unless these claims by their language expressly state otherwise.

The embodiments of the invention in which an exclusive property or privilege is claimed are defined as follows:

1. In combination a suspended article support having a supporting hook and a tubular tally secured to the article support and surrounding the supporting hook, said tally having an internal chamber opening through its top, an attachment display member comprising a body member having an indicia receiving arm and an integral foot; said arm having an indicia receiving display surface; said foot depending from said arm and of a width greater than the inside diameter of said tally; said foot being received in said tally and being bent about said support hook for urging the edges of said foot into tight frictional engagement with the inside wall of said tally.

2. The combination described in claim 1 wherein said body member is fabricated of a resilient, semi rigid plastic material and as fabricated is flat.

3. The combination described in claim 2 wherein said display surface extends laterally away from said supporting hook and bears informational indicia.

4. The combination described in claim 3 wherein said attachment display member has a laterally extending shoulder at the juncture of said foot and said arm.

5. In combination a suspended article support and a tubular tally secured to the article support, said tubular tally having a central well open at the top, an attachment display member comprising a normally flat body member of resilient material having a display portion and an integral foot portion; said foot depending from said display portion of a width greater than the inside diameter of said central well of said tally; said foot being received in said central well of said tally and being bent for urging the edges of said foot into tight frictional engagement with the inside wall of said well of said tally.

6. The combination described in claim 5 wherein said article support has a supporting hook and said tally surrounds the shank of said hook; said attachment when secured to said tally seating against said shank of said hook for holding said tally in generally erect position.

7. In combination an article support and a tubular tally secured to and extending upwardly from the article support, said tubular tally having a central well open at the top, an attachment display member comprising a normally flat body member of resilient material having a display portion and an integral foot portion; said foot depending from said display portion of a width greater than the inside diameter of said central well of said tally; said foot being forcibly received in said central well of said tally and for urging the edges of said foot into tight frictional engagement with the inside wall of said well of said tally.

* * * * *